United States Patent [19]

DeMars

[11] Patent Number: 5,005,160

[45] Date of Patent: Apr. 2, 1991

[54] GAME TIMING APPARATUS

[76] Inventor: Robert A. DeMars, 7210 Jordan Ave., Canoga Park, Calif. 91303

[21] Appl. No.: 505,165

[22] Filed: Apr. 5, 1990

[51] Int. Cl.[5] ..... G04F 1/04

[52] U.S. Cl. ..... 368/95; 368/93; 273/1 GE

[58] Field of Search ..... 273/272, 1 GE; 368/91, 368/93-96

[56] References Cited

U.S. PATENT DOCUMENTS 441,661 12/1890 Hawley ..... 368/95
2,941,350 6/1960 Rogovin ..... 368/95
3,101,587 8/1983 Patrick ..... 368/95
4,911,448 3/1990 Thomas ..... 368/95

*Primary Examiner*—Bernard Roskoski
*Attorney, Agent, or Firm*—Jack C. Munro

[57] ABSTRACT

A game timing apparatus to be used to limit a player's turn in the playing of a game. The game timing apparatus includes an hourglass with movement of sand within the hourglass defining the length of time of the player's turn. Connected to the hourglass and movable therewith is a card. The card includes word indicia in the form of a tongue-twister which is to be read by the player, memorized, and then repeated to the remaining players within the established time period.

6 Claims, 1 Drawing Sheet

GAME TIMING APPARATUS

BACKGROUND OF THE INVENTION

The field of this invention relates to a timing apparatus and more particularly to a timing apparatus that is designed to be utilized in conjunction with the playing of a game.

The use of timing devices in conjunction with games that limit the time period of a player's turn at playing of the game have long been known. Such timing apparatuses frequently take the form of some form of clock that is either to be operated mechanically or electronically. When the time period for the player's turn has expired, some form of a sound annunciator is activated usually in the form of a buzzer or a bell. One disadvantage of such timing devices is that the player is not able to determine that the time is running out.

Additionally, in the playing of games, there is commonly used some kind of playing apparatus. A common type of playing apparatus is some time of a card with generally there being available multitudes of such cards. It is common to inscribe some type of indicia on the card with of course there being multitudes of different kinds of indicia. Prior to the present invention it has not been known by the inventor to combine a game playing apparatus in conjunction with a timing apparatus.

SUMMARY OF THE INVENTION

The structure of the present invention utilizes a base upon which are mounted a pair of upstanding stanchions with the stanchions being located in a spaced apart relationship. Within the gap between the stanchion is located a mounting frame and within that mounting frame is mounted an hourglass. Mounted on the mounting frame at approximately the longitudinal center point are a pair of stub shafts which extend in opposite directions from the mounting frame. One stub shaft is to be rotatably supported by one stanchion with the other stub shaft being rotatably supported by the other stanchion. One of the stub shafts include a handle which is to be utilized to cause pivoting of the mounting frame. Within that mounting frame is located an hourglass with sand being located within the bulb of the hourglass. A preset period of time is expended in moving of the sand from one chamber of the bulb to another chamber of the bulb. The remaining stub shaft includes a clip with a card to be frictionally supported by the clip. The card is to be removable from the clip. The card is to include indicia in the form of a tongue-twister with this tongue-twister duplicated on the card in an up-side-down relationship so that the tongue-twister can be read regardless of which position the hourglass assumes.

DETAILED DESCRIPTION OF THE SHOWN EMBODIMENT

Figure 1:
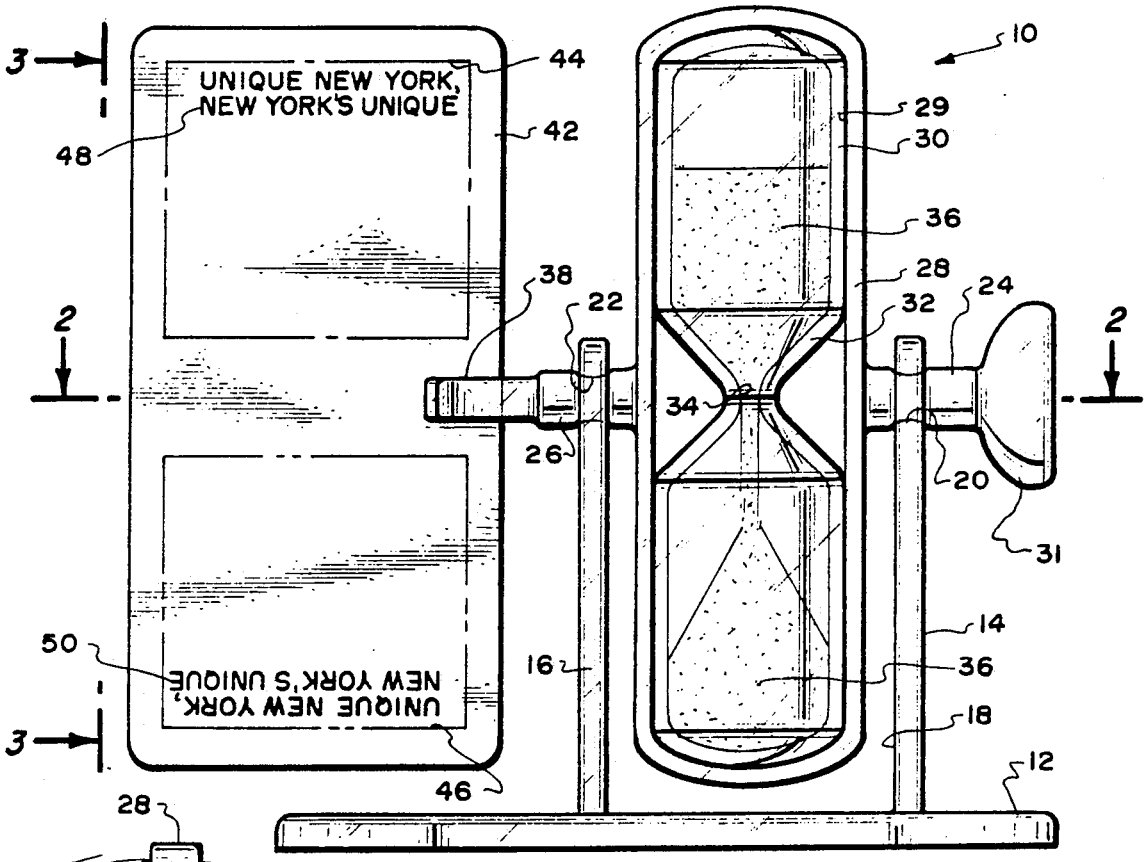
FIG. 1 is a front plan view of the game timing apparatus of the present invention.
Figure 2:
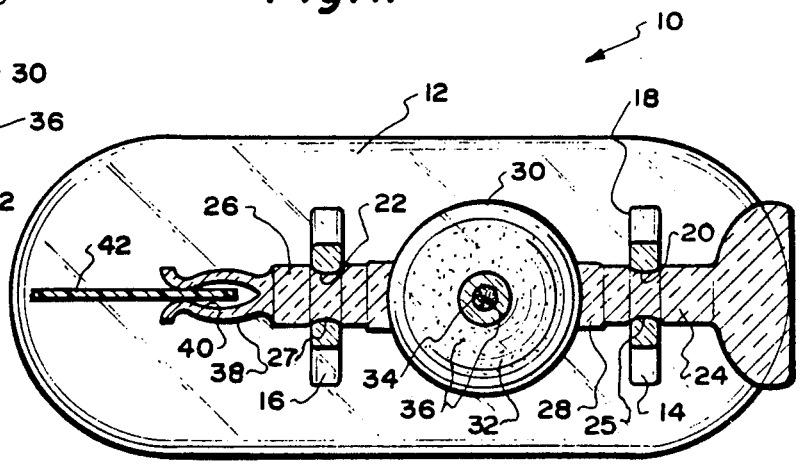
FIG. 2 is a cross-sectional view through the game timing apparatus of the present invention taken along line 2—2 of FIG. 1.
Figure 3:
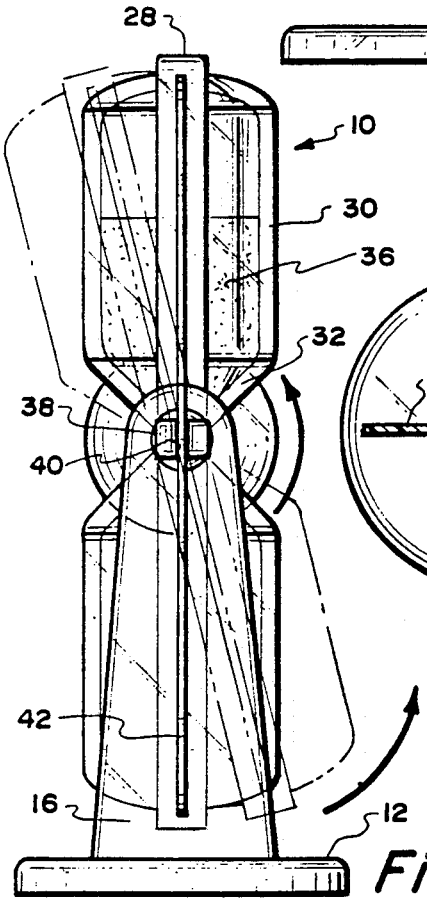
FIG. 3 is an end view of the game timing apparatus of the present invention taken along line 3—3 of FIG. 1.

Referring particularly to the drawing, there is shown the timing apparatus 10 of this invention which has a sheet material thin base 12 upon which are mounted a pair of identical stanchions 14 and 16 located in a spaced apart relationship forming a gap 18 therebetween. Each of the stanchions 14 and 16 are also constructed of sheet material and are about the same thickness as the base 12. Typical thickness of both the base 12 and the stanchions 14 and 16 would be approximately one-half inch. The base 12 and the stanchions 14 and 16 will normally be constructed of a rigid material such as plastic, wood, or metal.

Formed through the stanchion 14 directly adjacent the upper or free end thereof is a through hole 20. A similar through hole 22 is formed through the stanchion 16. A center line interconnecting the holes 20 and 22 would be parallel to the upper surface of the base 12. Conducted through the hole 20 is a stub shaft 24 with stub shaft 24 including an annular recess 25 which connects with the hole 20. A stub shaft 26 is conducted through the through hole 22 with stub shaft 26 including an annular recess 27 which connects directly with the through hole 22. Stub shafts 24 and 26 are in axial alignment. Stub shaft 25 is fixedly secured to one side of a totally enclosed mounting frame 28. Stub shaft 26 is fixedly secured to the opposite side wall of the mounting frame 28.

The stub shafts 24 and 26 are located substantially in alignment with the midpoint of the longitudinal axis of the mounting frame 28. Mounting frame 28 encloses an area 29. Snugly mounted within the mounting frame 28 within the area 29 is a bulb 30. Bulb 30 includes a necked down section 32 which forms internal restricted opening 34. Opening 34 separates a pair of identically sized chambers within the hourglass bulb 30. It is within these chambers that there is located a quantity of sand 36. With all the sand 36 located in the chamber that is nearest the base 12, and the bulb 30 then pivoted one hundred eighty degrees, there will be a certain length of time, such as thirty seconds, for the sand to flow through hole 34 until all the sand 36 is out of the now chamber that is located furthest from the base 12. The amount of time that is required for the sand 36 to flow from one chamber to the other establishes the amount of time.

Fixedly mounted onto the stub shaft 24 is a handle 31. The handle 31 is to be manually grasped and to be turned to thereby cause the pivoting of the bulb 30 as well as the mounting frame 28. During this pivoting motion, stub shaft 26 is also pivoted which means that clip 38 that is integrally connected to stub shaft 26 will also pivot. Clip 38 includes a gap 40 frictionally held by the walls of the clip 38. Within the gap 40 is a card 42. Card 42 will normally be constructed of a paper or plastic sheet material. Card 42 is designed to have a front and a back but only on one surface will thereby inscribed indicia blocks 44 and 46. Within each of the blocks 44 and 46 there will be printed a tongue-twister 48 and 50 respectively. The tongue-twister selected in both blocks 48 and 50 for the particular card 42 will be identical. It is to be noted that the tongue-twister 50 is upside-down to the tongue-twister 48.

The operation of the timing apparatus 10 of this invention is as follows: A player is to select a card 42 that has a particular tongue-twister 48 and 50 printed thereon. That particular player places the card 42 within the gap 40 of the clip 38. The player orients the card 40 so that that player will be able to observe the indicia 48 and 50. The player then asks his/her opponent player if they are ready to play the game. Upon the answer being affirmative, the first player then turns handle 31 sufficiently so that mounting frame 28 and bulb 30 as well as card 42 are pivoted one hundred eighty degrees. At this time, the opposing player reads for the first time tongue-twister 50 and practices saying that tongue-twister in order to memorize such until all of the sand 36 has moved from the upper chamber of the bulb 30 into the lower chamber. At that time, the player turns handle 31 again one hundred eighty degrees and now that player is able to read tongue-twister 48. Again, sand 36 begins to pour from the upper chamber of the bulb 30 into the lower chamber and the opposing player must accurately repeat that tongue-twister before the sand 36 again empties from the upper chamber of the bulb 30 into the lower chamber.

It is to be understood that once the particular card 42 is utilized, it is removed and utilized with another card containing another tongue-twister and the procedure repeated.

What is claimed is:

1. A game timing apparatus comprising:

a base, said base adapted to be placed on a planar supportive surface;

a mounting frame mounted on said base, said mounting frame including a pair of stanchions extending from said base and located in a substantially parallel spaced apart relationship defining a gap therebetween;

an hourglass mounted on said stanchions of said mounting frame, said hourglass being pivotably on said stanchions, said hourglass having a transparent bulb defining a pair of chambers separated by a necked down waist, said bulb having a longitudinal center axis, during sufficient pivotable movement of said bulb said longitudinal center axis will be perpendicular to said base, a quantity of sand located within said chamber, said sand being movable between said chambers during pivoting of said hourglass;

a support frame, said bulb being fixedly mounted on said support frame, said support frame being located within said gap, said support frame including a pair of stub shafts mounted directly adjacent said waist, said stub shafts being in axial alignment, one said stub shaft connecting with one said stanchion and the other said stub shaft connecting with the remaining said stanchion; and card mounting means mounted on one of said stub shafts, said card mounting means adapted to removably support a planar card upon which is located indicia, whereby as said hourglass is pivoted so is said card and said card mounting means.

2. The game timing apparatus as defined in claim 1 wherein:

said indicia comprising a series of words, said series of words including a tongue-twister phrase, said phrase being duplicated on said card thereby forming a pair of phrases, said phrases being identical and located in an upside-down position relative to each other.

3. The game timing apparatus as defined in claim 1 wherein:

said card mounting means comprising a clip, said clip functioning to frictionally engage said card.

4. The game timing apparatus as defined in claim 1 wherein:

a handle mounted on a said stub shaft, said handle being spaced from said card mounting means, whereby said handle to facilitate manual pivoting movement of said hourglass.

5. The game timing apparatus as defined in claim 4 wherein:

said indicia comprising a series of words, said series of words including a tongue-twister phrase, said phrase being duplicated on said card thereby forming a pair of phrases, said phrases being identical and located in an upside-down position relative to each other.

6. The game timing apparatus as defined in claim 5 wherein:

said card mounting means comprising a clip, said clip functioning to frictionally engage said card.

* * * * *